United States Patent [19]

Graboyes

[11] Patent Number: 4,537,124

[45] Date of Patent: Aug. 27, 1985

[54] EMBOSSER MOUNTING INSERT REGISTERING MEANS

[75] Inventor: Herman A. Graboyes, Mishawaka, Ind.

[73] Assignee: Atlas Steel Rule Die, Inc., Elkhart, Ind.

[21] Appl. No.: 574,716

[22] Filed: Jan. 30, 1984

[51] Int. Cl.[3] ..... B44B 5/02; B31F 1/07

[52] U.S. Cl. ..... 101/28; 72/478; 101/DIG. 12; 101/383; 101/394; 101/408; 269/137; 411/209; 411/315

[58] Field of Search ..... 101/383, 384, 390, 393, 101/394, 400, 408, 3 R, DIG. 12, 19, 20, 24, 26, 28, 30; 411/209, 315, 202, 203; 269/137; 72/478, 482; 83/640, 641, 700

[56] References Cited

U.S. PATENT DOCUMENTS

| | | | |
|---|---|---|---|
| 172,765 | 1/1876 | Olmstead | 101/24 |
| 573,552 | 12/1896 | Stevens | 101/384 |
| 921,974 | 5/1909 | Ginsburg | 101/28 |
| 1,029,021 | 6/1912 | Marsh | 101/226 |
| 1,071,215 | 8/1913 | Deckard | 101/383 |
| 1,196,489 | 8/1916 | Steiniger | 101/400 |
| 1,503,074 | 7/1924 | Swift | 101/378 |
| 1,528,819 | 3/1925 | Engel | 101/3 R |
| 1,858,273 | 5/1932 | Keene | 101/400 |
| 1,999,776 | 4/1935 | Nelson | 101/383 |
| 2,147,433 | 2/1939 | Flyer | 101/394 |
| 2,691,212 | 10/1954 | Hildebrand | 269/137 |
| 2,728,370 | 12/1955 | Neuschotz | 411/103 |

FOREIGN PATENT DOCUMENTS

| | | | |
|---|---|---|---|
| 1121559 | 1/1962 | Fed. Rep. of Germany | 269/137 |
| 525800 | 5/1955 | Italy | 101/383 |
| 5432 | of 1907 | United Kingdom | 269/137 |
| 265 | of 1914 | United Kingdom | 101/383 |

*Primary Examiner*—Clyde I. Coughenour
*Attorney, Agent, or Firm*—James D. Hall

[57] ABSTRACT

An embosser combined with a steel rule die for embossing sheets of stock where the embosser includes an insert positioned within an opening formed in the steel rule die. Threaded bores are formed in the steel rule die and extended into its opening. Screws are threaded into the threaded bores and contact the embosser insert such that longitudinal movement of the screw in the bore is translated into lateral movement of the insert for adjustable registration of the embosser with the print on a sheet of stock.

1 Claim, 4 Drawing Figures

EMBOSSER MOUNTING INSERT REGISTERING MEANS

SUMMARY OF THE INVENTION

This invention relates to a mounting insert for an embosser which is used in combination with a steel rule die, and a method of registering the embosser with a print.

Presently there is much difficulty encountered in registering the print on a sheet of stock to the embossing die. The embosser is cemented to the steel rule die after many trial and error attempts to register the embosser with the print. Also, cams are used to shift the insert embosser to obtain print registration. However, such cams are difficult to operate and add considerably to the expense of the die and set up.

The embosser mounting insert of this invention includes a block which is received with clearance within an opening formed in the steel rule die and to which the embosser is attached. Threaded bores are formed in the steel rule die and extend from the outer surface of the die into the block receiving die opening. A screw is turned into each threaded bore into contact with a side of the block. Longitudinal movement of each screw in its bore is translated into lateral movement of the block within the die opening so that the embosser carried by the block may be registered with the print on a sheet of stock.

It is an object of this invention to provide a novel and useful embosser mounting insert in combination with a steel rule Another object of this invention is to provide a novel and useful method of registering an embosser with a print.

Another object of this invention is to provide an insert which is for mounting an embosser into a steel rule die and which permits the registration of the embosser with a print on a sheet of stock with a minimum amount of trial and error.

Still another object of this invention is to provide a method of accurately registering an embosser with a print in a minimum amount of time.

Other objects of this invention will become apparent upon a reading of the following description.

DESCRIPTION OF THE PREFERRED EMBODIMENTS

Figure 1:
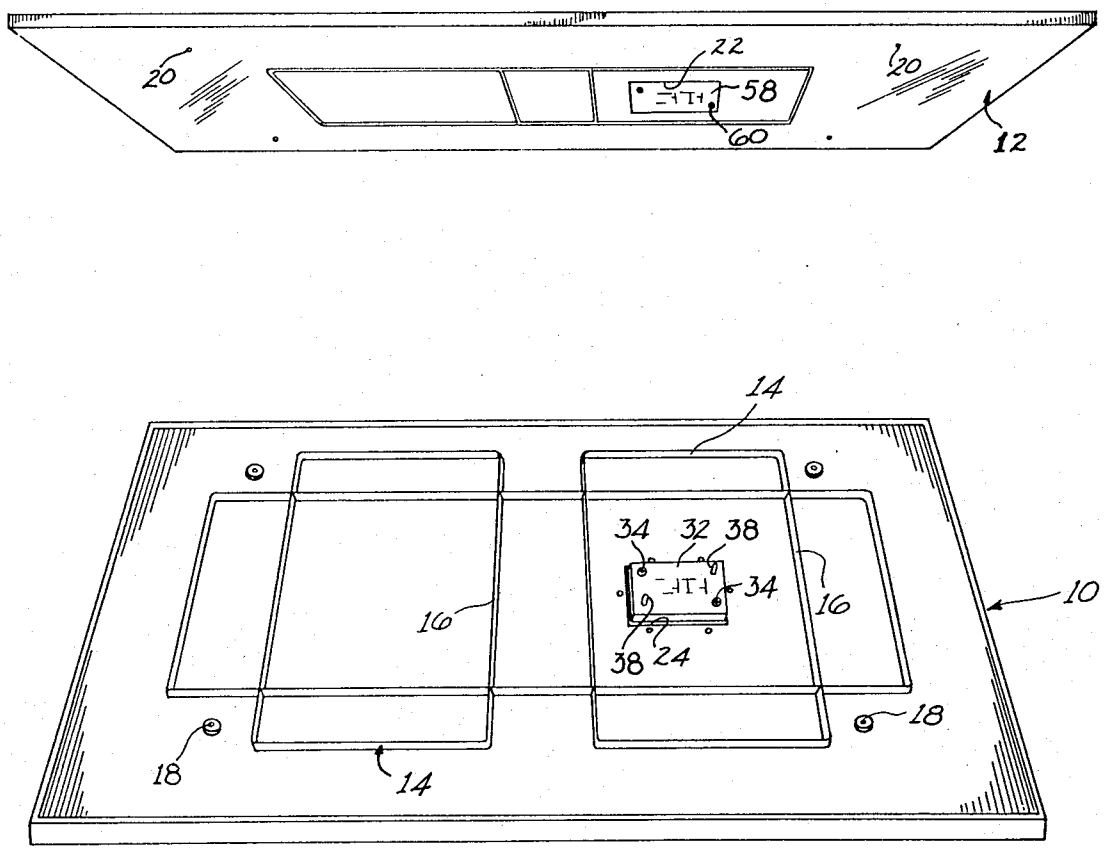
FIG. 1 is a perspective view of a steel rule die and a counterplate having an embosser mounted therein by the insert of this invention.
Figure 2:
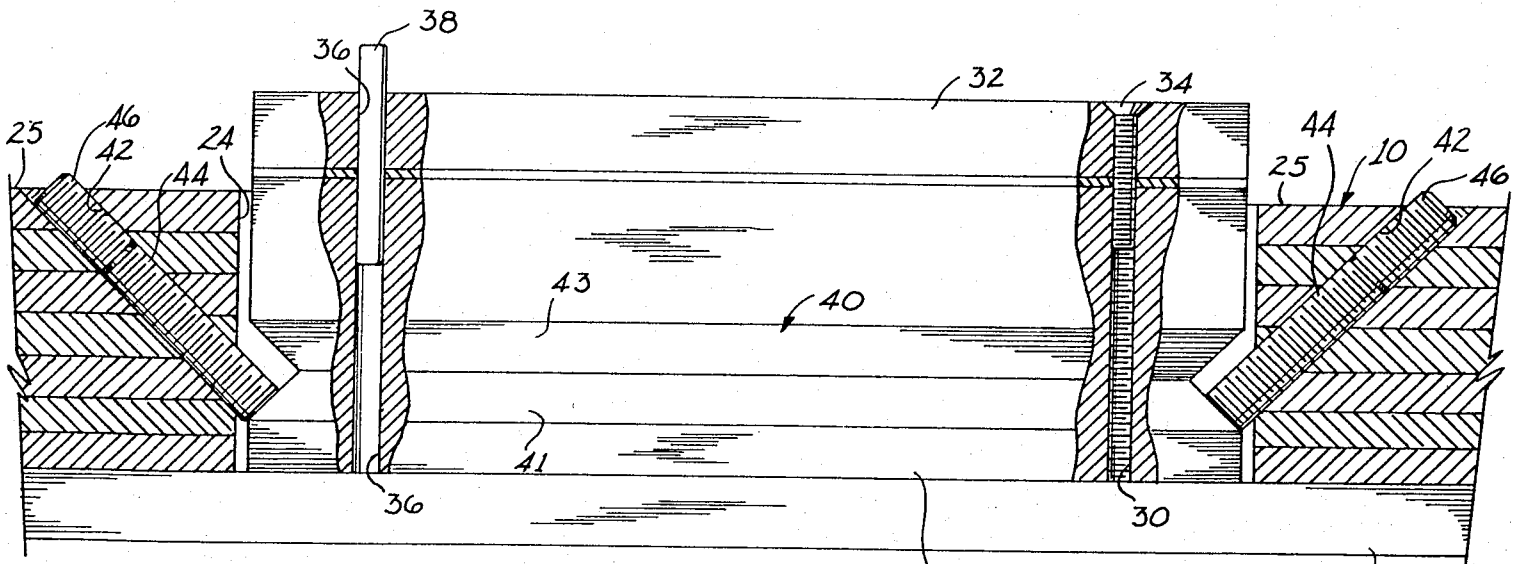
FIG. 2 is an enlarged fragmentary sectional view of the insert as seen in FIG. 1 with portions broken away for illustration.
Figure 3:
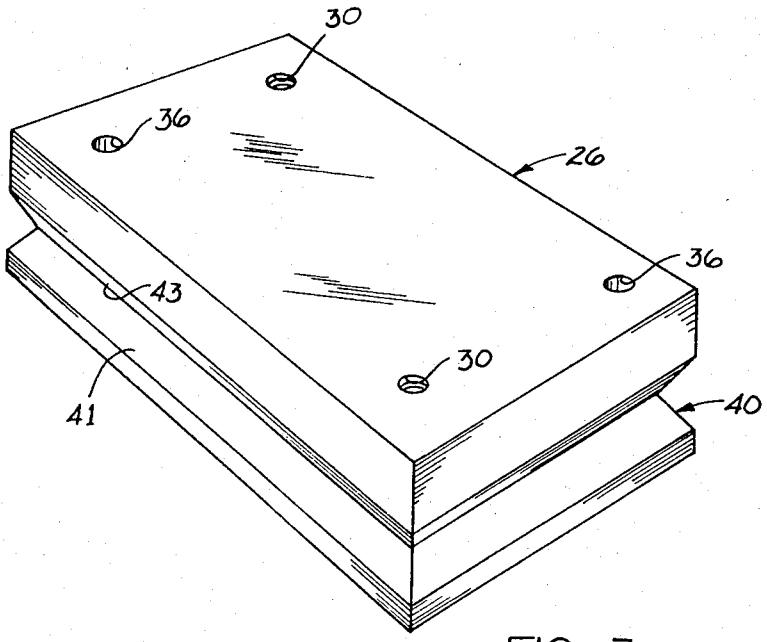
FIG. 3 is a perspective view of the insert.

The preferred embodiments illustrated are not intended to be exhaustive or to limit the invention to the precise forms disclosed. They are chosen and described in order to explain the principles of the invention and its application and the practical use thereof to thereby enable others skilled in the art to utilize the invention.

The embosser mounting insert of this invention is adapted for use with a steel rule die 10 in conjunction with a counterplate 12. Steel rule die 10 has knives 14 and scoring rules 16 mounted therein and is alignable with counterplate 12 through the use of guide pins 18 carried by the steel rule die which fit into openings 20 formed in the counterplate. Such construction is described in U.S. Pat. No. 4,341,008.

A four sided opening 24 is formed through steel rule die 10. The four sided embosser mounting insert 26 is fitted with clearance in die opening 24.

A female embossing die 32 is mounted to insert 26 and secured thereto by screws 34 which are turned into threaded bores 30 in the insert. Female embossing die 32 and insert 26 also have aligned smooth bores 36 which receive a registration pin 38 for purposes which will be explained below. Insert 26 includes a circumferential groove 40 which is generally V-shaped. That is, groove 40 includes flat surfaces 41,43 formed in the insert edge walls and disposed at an angle to each other formed in the insert edge walls.

Threaded bores 42 are formed in steel rule die 10 about die opening 24. Bores 42 extend at an angle from the outer surface 25 of die 10 into its opening 24 and each has an axis substantially perpendicular to surface 41 of V-shaped groove 40. As shown in FIG. 1, there are preferably two bores 42 located at each side of die opening 24. A set screw 44 is threaded into each die bore 42 and contacts at one end surface 41 of insert groove 40. By turning screws 44, such as with an allen wrench, longitudinal, axial movement of the screws is translated into lateral movement of insert 26 and female embossing die 32 relative to die 10, thereby providing for the adjustment of the position of the embossing die. Screws 44 all contact insert 26 and are accordingly loosened or tightened to shift and skew the insert and die 32. Surface 43 of insert groove 40 prevents the insert 26 from dropping out of insert opening 24 during movement of the die 10 to the press. Locking screws 46 are threaded into die bores 42 against screws 44 to prevent movement of screws 44 after final adjustment.

Figure 4:
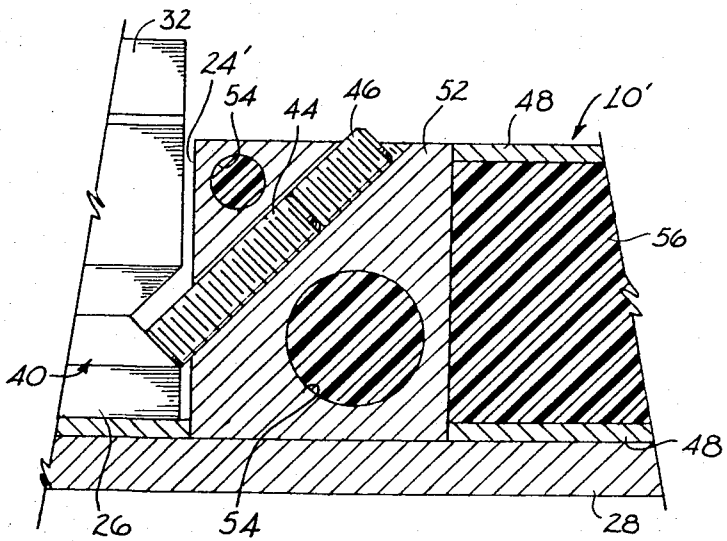
FIG. 4 is a sectional view showing a second embodiment of the invention adapted to use with a bonded steel rule die.

A second embodiment of the invention is shown in FIG. 4. This embodiment relates to adaptation of the invention to a bonded steel rule die 10'. Bonded steel rule die 10' is injection molded and includes upper and lower skins 48, preferably formed of thin sheets of metal, and an epoxy center 56. A block 52 is used to locate each screw 44 within die 10'. Each block 52 has openings 54 formed in it so that when epoxy 56 is injected between skins 48 as die 10' is formed, the epoxy flows through the openings and secures the block within the die. Each block 52 has a threaded bore 42' which communicates with the embossing die insert receiving opening 24' in die 10'. As shown in FIG. 4, insert 26 fitted within die opening 24' is contacted at its shaped groove 40 by screws 44 threaded into block bores 42'. When block 26 has been properly positions relative to die 10' through screws 44 in the manner explained above, locking screws 46 are turned into insert bores 42' to prevent further movement of each screw 44.

The invention also includes a method of registering the embossing die 32 with the print on a sheet of stock (not shown). The method includes first mounting insert 26 and attached female embossing die 32 within opening 24 in die 10. Then a print negative (not shown) of the sheet of stock is placed over and aligned with steel rule die 10. With the print negative so aligned, screws 44 are turned to position insert 26 and female embossing die 32 into initial registration with the print as it appears on the negative. The negative is removed from die 10. The die is then placed in a press and mounted to press platen 28. A sheet of stock is aligned with die 10. At this time, a pad of semi-rigid rubber, or similar material is placed within the male embossing opening 22 in counterplate 12. A strike is taken to test the registration of the female embossing die 32 with the print on the sheet of stock. If the registration is satisfactory, no furter adjustments are made. If the registration is not satisfactory, the embossing die 32 can be moved into registration by turning screws 44 to shift insert 26 as described above. Locking screws 46 are then threaded into bores 42 and turned against screws 44. When embossing die 32 is properly registered with the print, a male embossing die 58 is placed over female embossing die 32 with the pins 38 thereof fitting slidably into bores 60 in the male die.

The pad which was previously placed within counterplate opening 22 is removed, and cement is placed over counterplate 12 at the bottom of opening 22. When counterplate 12 is brought into contact with steel rule die 10 by the press, male embossing die 58 supported by female embossing die 32, is positioned within counterplate opening 22 and attached to the counterplate by the previously applied cement. After counterplate 12 is separated from steel rule die 10 by the press, pins 38 may be removed from female embossing die 32 in preparation for the embossing operation.

It is to be understood that this invention is not to be limited by the terms of the above description, but may be modified within the scope of the appended claims.

I claim:

1. In combination, a steel rule die and an adjustable embosser comprising a mounting insert carrying said embosser, said die having an opening herein, said die including knives circumscribing said die opening, said insert fitted into said die opening with clearance to permit lateral movement of the insert relative to the die, threaded bores formed in said die in communication with said die opening at opposite sides of the opening, adjustment screws turned into said die bores and contacting said insert such that axial movement of said screws is translated into said lateral movement of said insert to position said embosser relative to said die, said insert having a peripheral groove, said peripheral groove being V-shaped and having upper and lower surfaces, said adjustment screws abutting the lower surface of said peripheral groove for laterally moving said block to position said embosser relative to said die, said upper surface of said peripheral groove constituting means for contacting said adjustment screws to prevent separation of said insert from said die.

* * * * *